US010023330B2

(12) United States Patent
Schumann

(10) Patent No.: US 10,023,330 B2
(45) Date of Patent: Jul. 17, 2018

(54) YARN PACKAGING AND DELIVERY SYSTEM

(71) Applicant: INVISTA NORTH AMERICA S.A.R.L., Wilmington, DE (US)

(72) Inventor: David W. Schumann, Statham, GA (US)

(73) Assignee: INVISTA NORTH AMERICA S.A.R.L., Wilmington, DE (US)

( * ) Notice: Subject to any disclaimer, the term of this patent is extended or adjusted under 35 U.S.C. 154(b) by 618 days.

(21) Appl. No.: 14/420,972

(22) PCT Filed: Aug. 13, 2013

(86) PCT No.: PCT/US2013/054649

§ 371 (c)(1),
(2) Date: Feb. 11, 2015

(87) PCT Pub. No.: WO2014/028438

PCT Pub. Date: Feb. 20, 2014

(65) Prior Publication Data

US 2015/0217877 A1 Aug. 6, 2015

Related U.S. Application Data

(60) Provisional application No. 61/682,972, filed on Aug. 14, 2012.

(51) Int. Cl.
*B65B 1/08* (2006.01)
*B65H 54/84* (2006.01)
(Continued)

(52) U.S. Cl.
CPC ..... *B65B 1/08* (2013.01); *B65B 1/16* (2013.01); *B65B 1/22* (2013.01); *B65B 1/24* (2013.01);
(Continued)

(58) Field of Classification Search
USPC ..... 53/408, 436, 437
See application file for complete search history.

(56) References Cited

U.S. PATENT DOCUMENTS 2,707,806 A * 5/1955 Wilkie ..... B30B 9/3075 19/66 R
2,741,009 A 4/1956 Games et al.
(Continued)

FOREIGN PATENT DOCUMENTS

EP 0058478 A1 8/1982
GB 1217671 A 12/1970
WO 2014/028438 A1 2/2014

OTHER PUBLICATIONS

International Search Report and Written Opinion Received for PCT Application No. PCT/US2013/054649, dated Nov. 6, 2013, 9 pages.
(Continued)

*Primary Examiner* — Michelle Lopez
*Assistant Examiner* — Chinyere Rushing-Tucker
(74) *Attorney, Agent, or Firm* — Robert B. Furr, Jr.

(57) ABSTRACT

Included are apparatus and methods for preparing a yarn package for a small portion of yarn that provides substantially uniform tension on removal. The method includes providing an amount of yarn up to two pounds which is introduced to a small package with vacuum applied at the bottom of the container and vibration to assist yarn uniform packing of the yarn.

15 Claims, 3 Drawing Sheets

(51) Int. Cl.
*B65B 1/16* (2006.01)
*B65B 1/22* (2006.01)
*B65B 1/24* (2006.01)

(52) U.S. Cl.
CPC ..... *B65H 54/84* (2013.01); *B65H 2701/31* (2013.01)

(56) References Cited

U.S. PATENT DOCUMENTS 3,186,660 A * 6/1965 Cook ..... B65H 54/84 19/159 R
3,387,756 A * 6/1968 Goodner ..... B65H 51/16 226/97.4
3,397,437 A * 8/1968 McNeill ..... B65H 51/16 28/289
3,594,878 A * 7/1971 Porter ..... D02G 1/12 28/255
3,759,010 A 9/1973 Boggs
4,081,888 A * 4/1978 Hasegawa ..... B65H 54/80 28/285
4,085,881 A 4/1978 Roberson
4,863,029 A 9/1989 Koskol et al.
4,866,822 A 9/1989 Keedy, Jr. et al.
4,956,901 A * 9/1990 Koskol ..... B65D 85/04 28/250
5,423,170 A 6/1995 Dammann et al.
6,370,747 B1 4/2002 Lewin et al.
6,634,585 B1 * 10/2003 Ingram ..... B65H 49/16 242/131.1
7,004,415 B2 2/2006 Ingram, III

OTHER PUBLICATIONS

International Preliminary Report and Patentability Report Received for PCT Patent Application No. PCT/US2013/054649, dated Feb. 26, 2015, 7 pages.

* cited by examiner

YARN PACKAGING AND DELIVERY SYSTEM

FIELD OF THE INVENTION

The invention relates to a method for preparing a yarn package which includes application of vacuum to the end of the package. The yarn can be removed from the package with few or no entanglements.

BACKGROUND OF THE TECHNOLOGY

Carpets (or other fabrics) are tufted or woven using many hundreds of threadlines of yarn (depending on the width of the fabric and the fiber spacing) that are supplied from yarn wound on multiple beams or from singles packages arranged in some sort of creel. For small lot production this is time consuming and expensive since the same large number of threadlines must be provided for each yarn across the width of the fabric and must be prepared by making many short yardage beams or rewinding the yarn into a very large number of smaller packages (or alternately the supplier can produce smaller yarn packages, but at greatly increased production cost). The small lots also result in a larger number of tufter or loom changeovers, resulting in lost machine capacity and lower yields from the transition time and waste from pulling through the transition yarn knots.

U.S. Pat. No. 6,634,585 to William O. Ingram, III (Compact Creel—Oct. 21, 2003) describes a compact, mobile creel that can be prestocked with a large number of small size packages of yarn and moved to the tufter when changing to the next production order. This apparatus accentuates any tension plucks as the yarn is removed from the packages that can cause carpet tufting or weaving defects and limit the processing speed due to the yarn routing from the tube surface back through a plastic tube that passes through the yarn core. As the size of the fabric being produced decreases the diameter of the supply yarn packages is largely fixed by the diameter of the package paper/plastic core and the space needed to store the supply packages per pound of yarn rapidly increases. Space must also be provided between adjacent packages of yarn so that the threadlines do not become entangled when the yarn is removed from the packages. Vertical orientation of the packages above each other allows the yarn to drop down when the machine is stopped onto the packages below despite the horizontal monofilament separating threadlines provided, which can cause machine outages due to capture of threadlines from the adjacent packages when the machine is restarted. This results in higher shipping costs and increased warehouse and operating room requirements.

Tube banks or sample creels have also been used for making very small production lots. In this method plastic pipe or paper tube storage containers are connected to each of the threadlines going into the tufter or loom. Yarn is taken from large size supply packages and is blown into the top of each of the containers with a compressed air yarn entrainment device. Only a very limited length of yarn can be placed in the tubes, and frequent problems with entangling of the yarn when it is withdrawn are encountered. In practice this method is only used for small sample machines and for short lengths of tufted or woven fabric. These devices are commercially available from a number of equipment suppliers and are well known in the industry.

U.S. Pat. No. 3,759,010 to Beryl Aaron Boggs (Screw Jet Pack For Textile Fibers—1973), describes an apparatus for placing single ends of yarn into a plastic casing which can later be stripped off when fiber is to be used. This is a complex system and no method for producing many small length packages and effectively using them on a tufter or loom is disclosed.

There are a number of US Patents to Joseph E. Koskol, et al. —Apparatus And Process For Packaging Yarn And Product Therefrom (U.S. Pat. No. 4,863,029) and Apparatus and Process For Forming A Wad Of Yarn (U.S. Pat. No. 4,956,901). These describe a method for forming wads of compacted yarn and placing them in layered yarn packages. The equipment is complex and was purposed at packaging large quantities of yarn rather than a large number of very small packages of yarn. There is also concern about changing the supply yarn appearance or properties by passing it through a wad forming jet using high velocity air or steam and post processing at elevated temperatures when further compacting the yarn before packaging.

U.S. Pat. No. 4,081,888 to Hasegawa et al. describes an apparatus for producing compact yarn packages. This process uses an off-center (eccentric) introduction of yarn and pressing head on the opposite side of a cylindrical accumulation chamber to compact yarn packages, as well as other features. Motive gas used to place yarn in the chamber escapes from top section of the accumulation chamber, and steam is used as a heating fluid. This is a complex mechanism whose purpose was to produce a block of yarn that was much higher in weight than required to accomplish the objectives of small lot carpet or fabric fabrication.

U.S. Pat. No. 2,741,009 to Slayter and Anderson describes dropping filaments of yarn (specifically glass fiber) into an open top container that has perforations on the sides and bottom to permit air removal by a blower to hold the fibers in place and more tightly pack them. Packaging in this manner would result in too low a density for BCF or other similar fibers, and the containers would be too large for practical use to supply tufting or weaving equipment.

GB1217671 to Waring describes a process for handling wool during scouring, dyeing, and other downstream processing, where yarn is introduced into a cage made of metal mesh via a compressed air powered pulling device, and then the yarn is compacted by pulling air from the bottom of the cage by a fan. Packaging in this manner would result in too low a density for BCF or other similar fibers, so containers too large for practical use to supply tufting or weaving equipment with a large number of packages of yarn are needed for weaving or tufting.

U.S. Pat. No. 4,085,881 to Roberson describes a device for processing glass fibers that uses air exhausted from the sides and bottom of a canister to hold spun fibers in place and compact them to a higher density. Includes description of control mechanisms to produce package of fiber that is claimed to be of uniform density. Packaging in this manner would result in too low a density for BCF or other similar fibers, and the containers produced would be too large for practical use to supply tufting or weaving equipment.

EP58478 to Lowe and Brinton describes an apparatus for filling containers of yarn for use in making patterned fabrics for small quantity contract end uses where the lengths of the yarn may be controlled separately for each container to minimize waste. Further, the vertically oriented containers are fixed together on movable trolleys holding typically 288 tubular containers. The yarn is conveyed into the receiving chamber via an air jet and the air allowed to escape from the bottom through perforated, movable gates. The density of the yarn is then increased via pressing with a ram, the gates are opened, and the yarn pushed into a second container which has a perforated bottom plate. The trolley is indexed to allow filling a portion of the tubular containers from a smaller number of yarn supply devices. A sufficient number of trolleys containing the large number of tubular containers are moved to a carpet loom where the individual threadlines are routed to the loom via individual plastic tubes. EP58478 teaches placing the yarn into the container via a high velocity jet powered by compressed air, and then allowing the air to pass through the accumulated mass of yarn at the bottom of the container before passing out through perforated gates. The expansion of the compressed air as it leaves the jet and enters the container will lead to recirculation and possible tangling of the yarn as it falls into the container. This becomes especially problematic as the mass of yarn builds up in the container and the pressure drop across the mass of yarn increases, or as the amount of compressed air must be increased to attain higher yarn processing speeds. The height of yarn that can be accumulated in the container is limited by stirring or entangling of the surface of the yarn wad as the amount of compressed air must be increased to overcome the pressure drop of the yarn mass as the vertical height increases. This limits the density of the yarn mass that can be obtained, necessitating mechanical compaction of the wad with its associated complexity in order to store a reasonable amount of yarn in a compact container. Snagging or catching of the yarn on the pair of perforated gates at the bottom of upper container is also likely problematic for finer denier fibers as the wad of yarn is pushed from the upper to the lower container.

SUMMARY OF THE INVENTION

Although a number of attempts have been made to resolve the problems caused by small lot production, these solutions fail to be effective as lot sizes continue to decrease due to market pressures. There is a need for a method for preparing, transporting, and supplying the large number of threadlines to a tufter or loom in a very low cost, efficient, and low occupied volume manner that will also allow for rapid changeover and high operating efficiency.

These problems may be addressed by a method for providing a yarn package including:

(a) providing an amount of yarn greater than zero up to about two pounds;

(b) passing a first end of said yarn through a yarn guide to a narrow end of an optional first air diffuser and through the first air diffuser to a wide end adjacent to a hollow extension portion, (c) passing the first end of said yarn through said hollow extension portion adjacent to a first opening of a hollow yarn container;

(d) passing the first end of the yarn through said yarn container and attaching the first end of the yarn to a second opening of said yarn container, wherein porous media is present at the second opening of the yarn container;

(e) applying vacuum to a narrow end of a second air diffuser, where a wide end of the second air diffuser is adjacent to the second opening of said yarn container; and (f) applying vibration to the yarn.

Yarn containers for small lots are prepared in some aspects. These yarn containers can be transferred in a shipping container including several vertical yarn containers. The yarn can then be removed from the containers directly to a tufting process. Yarn containers prepared by the method of some aspects demonstrates significantly lower tension spikes compared to prior methods.

DETAILED DESCRIPTION OF THE INVENTION

Figure 1:
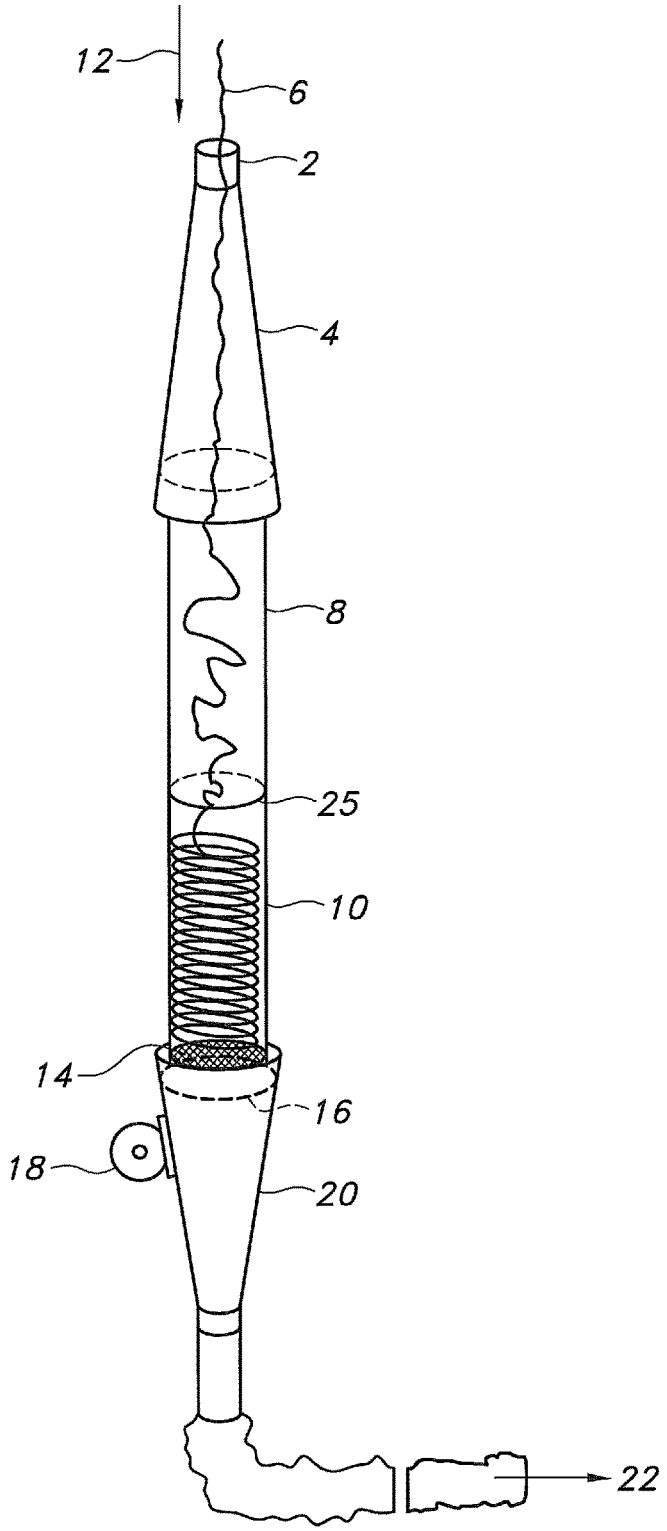
FIG. 1 is a side view of an apparatus of some embodiments.

Included in some aspects is an apparatus and method for packaging yarn for tufting or weaving for small lot fabric production that provides a large number of small yarn packages in a very compact arrangement that is inexpensive to ship, store, and locate at the tufter or loom. In use, efficiency improvements are obtained by the present methods by the yarn freely dispensing from the container rather than being removed from a wound package. In addition, the vertical arrangement and removal of the yarn from the mobile creel at the tufter or loom simplifies the threadline routing from the container to the tufter or loom and minimizes the tension placed on the threadlines by friction from the yarn routing tubes or guides. The containers themselves may be reused or refilled after the yarn is removed.

In some aspects, the yarn is placed into a container without forming tangles or loops that cause problematic snagging during yarn removal and in a compacted form that allows for several thousand yards of high denier carpet yarn to be placed into a small, compact container. The yarn may be of any suitable linear density such as about 600 denier to about 10,000 denier. Any of a variety of different yarns can be included, including but not limited to, polyamide, polyester, copolymers thereof and combinations thereof. The yarns themselves may be single filament, multiple filament and may also be twisted, air-entangled, etc.

Preventing tangles or loops as encountered by use of a tube bank/sample creel is accomplished by introducing the yarn into the container without recirculation of the air (or other fluid) that was used to pull the yarn into the container by the use of inlet diffuser and removal of the motive air via a suction at the bottom of the container.

Other devices suffer from loops and tangles due to recirculation of the air used to "push" the yarn into the container and use complex means to remove the motive air so that it does not impact the yarn as it drops into the container. In the method of some aspects, suction removes the air used to pull the yarn into the container through a porous media that allows free movement of the air with minimum pressure drop while not allowing any of the yarn to pass into the suction header. Higher density storage of the yarn was obtained by the use of an extension tube on the top of the container to allow additional disengagement distance for the yarn to separate from the air stream and settle into the container, compaction of the yarn due to the pressure drop through the accumulating mass of yarn at the bottom of the container, vibrating the apparatus to facilitate movement of the yarn down into the tube, and lastly by use of a mechanical compaction device to push the yarn down from the extension section into the container after stopping the yarn movement into the apparatus. The free end of the yarn going into the container is then cut, moved to the edge of the container top opening, and then a "cap" (not shown) may be placed on top of the container to capture the free end and prevent soiling of the yarn during shipping. Alternately a unit containing a number of cavities similar in dimensions to the containers above could be indexed or moved between the inlet and outlet diffusers to allow filling the cavities and reduce the number of individual containers that had to be handled.

Figure 3:
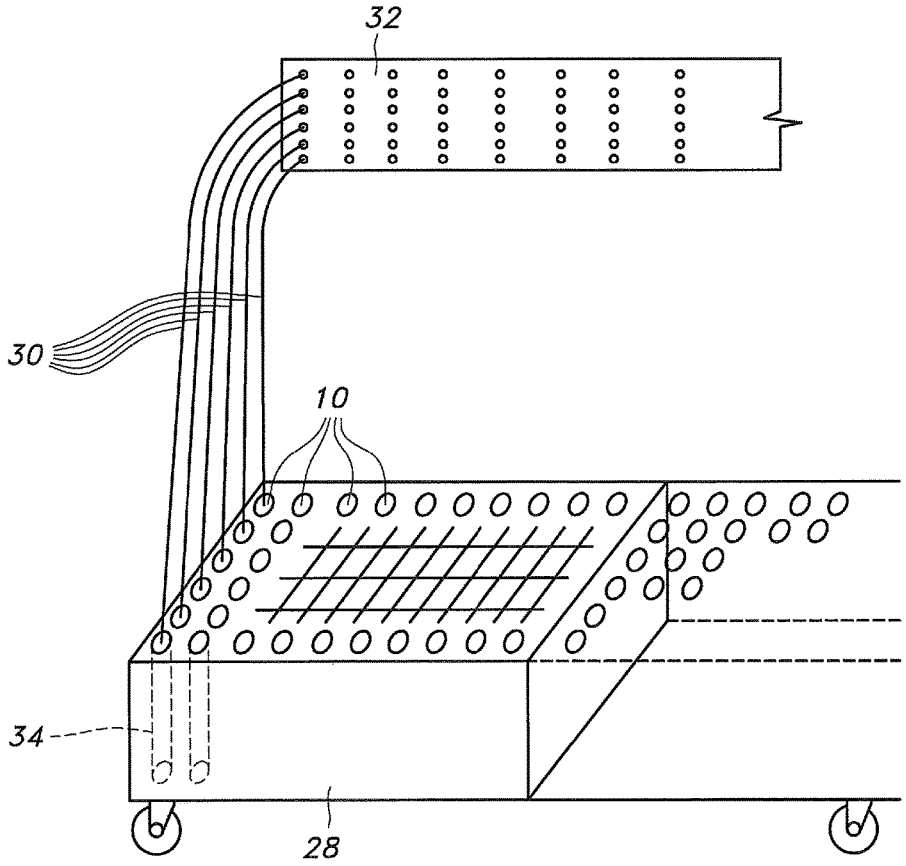
FIG. 3 is a schematic of delivery system including yarn containers of some embodiments.

After the yarn is placed into the container it is removed from the packaging apparatus and placed into a reusable, standardized, stackable shipping/dispensing receptacle along with any suitable number of other containers. This may be about 30 to about 500 or about 50 to about 200 other containers. The number can vary depending on the requirements for downstream handling, product design, or processing which contains yarn for the same production run of fabric to be produced on the tufter/loom. Alternately, a number of the units with multiple cavities can be combined into the receptacles for shipping, handling, and dispensing. The receptacles are designed so that they will interlock when stacked several high for handling, shipping, and storage. A sufficient number of receptacles are then preloaded into a mobile creel(s) at the carpet/fabric manufacturing facility to supply the necessary number of threadlines for the tufter or loom warp threadlines. The mobile creel as shown in FIG. 3 is equipped with plastic yarn transporting tubes located above the centerlines of where each of the containers of yarn will exit vertically from the containers to facilitate transport of the yarn and minimize the amount of tension generated by the threadlines moving through the plastic tubes and other guides. This is a much more compact and simplified configuration than as shown in U.S. Pat. No. 6,634,585 where the yarn packages are oriented horizontally and space must be allowed for the yarn to not entangle with the adjacent packages of yarn. The devices for "holding" the packages of yarn are also much less expensive and maintenance intensive since they do not have to grip the inside of the paper/plastic tubes or contain the yarn transport tubes.

The apparatus and methods described herein are useful with a number of different yarn sources. One suitable method includes using single which are twisted air entangled, then prepared into yarn packages as described. Alternatively, the yarn may be a spun yarn which is run through a twister and then packaged herein. Where a reduction in yarn processing steps is desired, the packaging method of some aspects can be coupled to a yarn preparation machine, which avoids the need for winding on a paper tube. Also, yarn may be removed from larger packages, unwound and repackaged as a smaller packaged according to the method of some aspects. Optionally, the yarn may be air entangled or twisted prior to preparation of the yarn packages of some aspects.

FIG. 1

Figure 2:
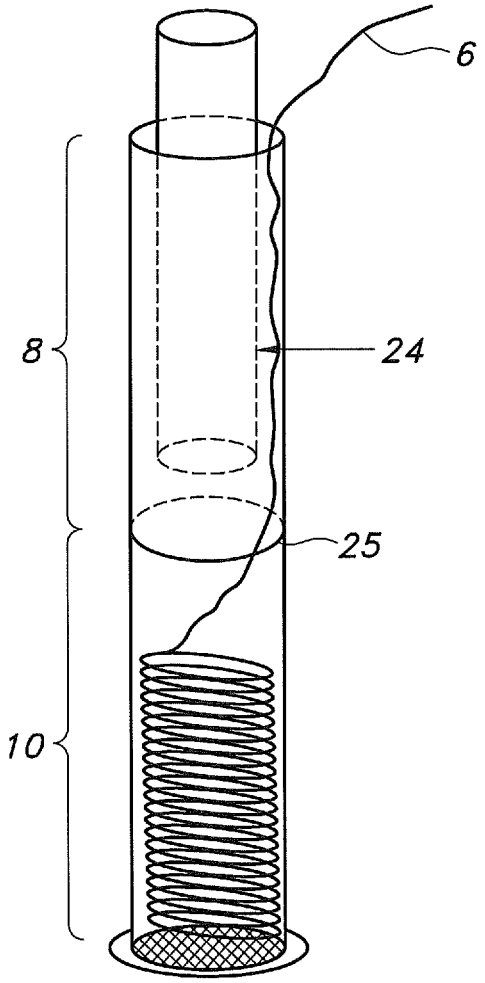
FIG. 2 is a side view of a container of yarn with extension of some embodiments.

In direction 12, yarn 6 enters at low tension as it is pulled through yarn guide 2 such as a ceramic eyelet or venturi shaped piece. Any of the yarn guides useful in the method of some aspects may be made of any suitable material. Examples include, but are not limited to, ceramic, metal, plastic and combinations thereof. Then, air velocity is reduced to prevent recirculation through an optional first air diffuser 4. The yarn 6 then enters the extension 8 of the container 10 and accumulates in the container 10. The yarn container may be of any suitable size or shape as needed to hold the necessary small amount of yarn. The cross-section may be any suitable configuration such as round, square, regular polygon or irregular polygon. Air pulling the yarn into the apparatus is pulled out of the bottom of the container 10 through a porous media or filtration media 14 (any suitable material such as a mesh filter, a perforated plate or a screen or combinations thereof) located at the bottom of the container 10 that prevents yarn 6 from exiting the container 10. A second air diffuser 20 is included to promote uniform flow across the bottom of the container, and then into a vacuum source 22. The extension is used to provide additional distance for disengagement of the yarn from the air stream and to allow a larger vertical height of yarn to accumulate before is compacted mechanically as shown in FIG. 2. Vibration means 18 may be applied to the second air diffuser 20 to facilitate downward movement of the yarn 6 and increase the density of the yarn 6 in the container 10. The vibration may be constant vibration, an intermittent vibration, or a combination thereof. The vibration may assist settling of the yarn 6 in the container 10. The yarn may be introduced into the yarn container at any suitable rate such as about 500 yards per minute to about 1000 yards per minute.

FIG. 2

After the desired amount of yarn is placed in the combination of extension 8 and container 10, they are removed from the top (optional) and bottom air diffusers and the yarn is mechanically compressed with a compaction plunger 24. This moves the yarn 6 down completely into the container 10 and the extension 24 can then be removed at separation point 25.

FIG. 3

Several yarn containers 10 placed in compact, high density shipping/dispensing receptacle, which allows vertical orientation 34 removal of yarn through guides 30 at the tufter/loom with simplified, lower tension feeding of the yarns. The container and shipping system permits the storage, transport and removal of the yarn from a vertical orientation. In one suitable method the yarn may be transferred through the yarn guides to an eyeboard 32 prior to tufting (not shown). In operation, the yarn removal tension will be substantially uniform meaning that the there are no surges in tension, i.e., tension spikes.

The features and advantages of the present invention are more fully shown by the following examples which are provided for purposes of illustration, and are not to be construed as limiting the invention in any way.

EXAMPLES

Testing done to demonstrate this concept is as shown below for a single container, using 2-ply air entangled SDN yarn (nylon 66, 1245 singles denier having been already processed) with four hole hollow-fill cross-section.

Example 1

Set yarn entrainment device compressed air pressure=60 psig so it would smoothly pull yarn from package on creel peg.

Filled PVC pipe container with yarn to approx. 28 inches above HVAC filter media at bottom of pipe.

Removed top air diffuser while vacuum continued to remove air from bottom, and level of yarn in the pipe fell to 20 inches above HVAC filter due to increased air flow. The vacuum was provided by a Shop-Vac® Model 2015 Wet/Dry vacuum.

Tapped on side of pipe to simulate vibration and level of yarn dropped to 18 inches.

Removed container of yarn and determined weight of yarn in container=0.53 pounds after subtracting tare weight of container.

Used wooden creel peg ~$2\frac{11}{16}$ inches in diameter with non-rounded bottom face to mechanically compact the yarn in the container to level 11 inches above HVAC filter. Used moderate force (30-40 pounds estimated).

Removed yarn from container by hand at ~50 yards per minute without any snarls or tangles.

Example 2

Same conditions as Test 1, filled yarn to approx. 29 inches above HVAC filter level.

Removed top diffuser while vacuum still applied and level of yarn dropped to 20 inches.

Tapped container on floor to simulate vibration after removal from vacuum source, and yarn level dropped to 16-17 inches.

Used mechanical compaction device (wooden creel peg) and compressed yarn level down to 10 inches.

Weight of yarn in container=0.51 pounds.

Example 3

Same conditions as Test 1. Took ~2 minutes to fill container with yarn.

Weight of yarn in container=0.54 pounds.

Based on definition of denier as grams/9000 meters the mass per unit length of 2-ply 1245 SDN=0.000557 lb./yard.

For 0.54 pound yarn weight, calculated yarn length in container=0.54/0.000558=968 yards.

Approximate yarn speed into container=968 yards/2 minutes=484 yards per minute.

Summary from Examples

For 3.042 inch I.D. container size, 11 inches of yarn vertical height, and 0.53 pounds of yarn on 2-ply air entangled 1245 denier SDN singles.

Yarn density obtained=0.00663 Lb/cubic inch or 0.183 g/cubic cm

Weight of yarn per vertical foot=0.58 pounds

Calculated length of yarn per vertical foot=1056 yards

So, if require 1 pound of yarn would require container with 1.72 feet vertical height of yarn

CONCLUSIONS

1. Method to effectively produce large number of metered quantities of yarn to support small lot tufting or weaving versus rewinding or on-line production of small (less than 1 pound) wound yarn packages.

2. Improved yarn processing on tufter or loom from vertical yarn removal from containers versus stripping yarn off end of small diameter wound packages. Removes problematic removal of yarn from near package core due to frequent winding ribbon zones, high number of yarn wraps per traverse stroke, and snags on end of core or core end caps.

3. Improved yarn delivery from vertical yarn removal from containers versus wound packages supported in horizontal or slightly angled orientation where the yarn can drop down and become entangled with yarn packages located below during stopping/starting or running.

4. Compact form that is ready to be installed in the tufter or loom creel when received versus wound packages that must be manually stocked after removal from shipping boxes or other containers. Compact versus wound package creel packaging that has hollow core that occupies significant space on small quantity packages and due to need to separate the individual wound packages from each other to allow yarn removal without snagging yarns from adjacent packages.

5. Process may be installed on off-line machine pulling yarn from packages of yarn placed in a creel, or directly in line with yarn processing equipment such as air entangling machines. Yarn speed demonstrated approximately 500 yards per minute, with additional improvements predict to be equivalent to rewinding or air entangling machines that can process at speeds of up to 1000 meters per minute.

6. Modest improvements in the amount of yarn mass compaction over those obtained in Tests 1 to 3 via additional work using increased air flows/controls and vibratory settling should make it possible to place 1 pound of yarn in a container less than 24 inches in vertical height without use of the second mechanical compaction step. This would result in a much less complex, lower cost process than those cited in U.S. Pat. No. 4,081,888 and EP058478.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. A method for providing a yarn package comprising:

(a) providing an amount of yarn greater than zero up to about two pounds;

(b) passing a first end of said yarn through a yarn guide to a narrow end of a first cone-shaped air diffuser which reduces air velocity and prevents recirculation and through said first air diffuser to a wide end adjacent to a hollow extension portion, (c) passing said first end of said yarn through said hollow extension portion adjacent to a first opening of a hollow yarn container having a top and a bottom;

(d) passing said first end of said yarn through said top of said yarn container and attaching said first end of said yarn to a second opening at said bottom of said yarn container, wherein porous media is present at said second opening of said yarn container so that yarn accumulates in said bottom above the second opening of said yarn container;

(e) applying vacuum to a narrow end of a second cone-shaped air diffuser, wherein a wide end of said second air diffuser is adjacent to said second opening of said yarn container to promote uniform airflow across said bottom of said yarn container and into the vacuum; and (f) applying vibration to said yarn to facilitate downward movement and increase density of the yarn in said yarn container.

2. The method of claim 1, wherein said yarn container has a cross section selected from round, square, regular polygon and irregular polygon.

3. The method of claim 1, wherein said yarn guide comprises a material selected from ceramic, metal, plastic, and combinations thereof.

4. The method of claim 3, wherein said yarn guide is a ceramic eyelet.

5. The method of claim 1, wherein said yarn package has a removal tension that is substantially uniform and which introduces no surge in tension.

6. The method of claim 1, wherein said yarn has a density from about 600 denier to about 10,000 denier.

7. The method of claim 1, wherein said yarn package comprises a polymer selected from the group consisting of a polyamide, a polyester, copolymers thereof and combinations thereof.

8. The method of claim 1, further comprising placing a plurality of said yarn packages in a vertical orientation on an assembly for shipment.

9. The method of claim 1, further comprising compacting said yarn with a plunger.

10. The method of claim 1, wherein said yarn is twisted, entangled, or combinations thereof.

11. The method of claim 1, wherein said porous media comprises a mesh, a filter, a perforated plate, or a screen.

12. The method of claim 1, wherein said vibration is applied to assist settling of the yarn within the yarn container.

13. The method of claim 1, wherein said vibration is selected from a constant vibration, an intermittent vibration, and combinations thereof.

14. The method of claim 1, wherein upon removal of said yarn from said package, the package is able to be refilled.

15. The method of claim 1, wherein said yarn is caused to move through said yarn guide, through said first air diffuser, and into said yarn container at a rate of about 500 yards per minute to about 1000 yards per minute.

* * * * *